United States Patent [19]

Staurseth

[11] 4,348,960

[45] Sep. 14, 1982

[54] AERIAL CABLEWAY BETWEEN A SEA VESSEL AND A FIXED INSTALLATION

[75] Inventor: Erik Staurseth, Mandal, Norway

[73] Assignee: Westamarin A/S, Mandal, Norway

[21] Appl. No.: 192,236

[22] Filed: Sep. 30, 1980

[30] Foreign Application Priority Data

Oct. 10, 1979 [NO] Norway ..... 793262

[51] Int. Cl.[3] ..... B61B 7/02

[52] U.S. Cl. ..... 104/114; 104/173 R; 254/283

[58] Field of Search ..... 254/283, 284, 285, 286, 254/287, 290, 335; 104/114; 414/139, 138; 212/75, 119

[56] References Cited

U.S. PATENT DOCUMENTS

| | | | |
|---|---|---|---|
| 2,942,740 | 6/1960 | Pristach | 414/138 |
| 3,032,082 | 5/1962 | Vilain | 414/139 X |
| 3,500,764 | 3/1970 | Warman | 104/114 |
| 3,828,683 | 8/1974 | Lehrer | 104/114 |

*Primary Examiner*—Billy S. Taylor

*Attorney, Agent, or Firm*—Young & Thompson

[57] ABSTRACT

An aerial cableway for transferring personnel/goods between a vessel and a fixed installation at sea, consisting of a support cable stretched between the vessel and the fixed installation. A winch provided with a slippage device maintains constant tension in the support cable which, by means of a securing member, is releasably attached to a complementary securing member on the vessel. A gondola is suspended from a trolley on the support cable. A pulling line attached to the trolley controls hauling the gondola up and down the support cable between the vessel and the fixed installation by means of a pulling winch on the fixed installation. The fixed installation is provided with an outrigger at the outer end of which the securing member for the support cable is fastened so as to be able to be raised and lowered by means of a hoisting cable which is maneuverable from the fixed installation. A drop line is attached to the securing member which, when the securing member and thus also the support cable have been hoisted into an elevated, not-in-use position, hangs down toward the surface of the sea, where it can be picked up by a wessel for establishing an aerial cableway.

2 Claims, 1 Drawing Figure

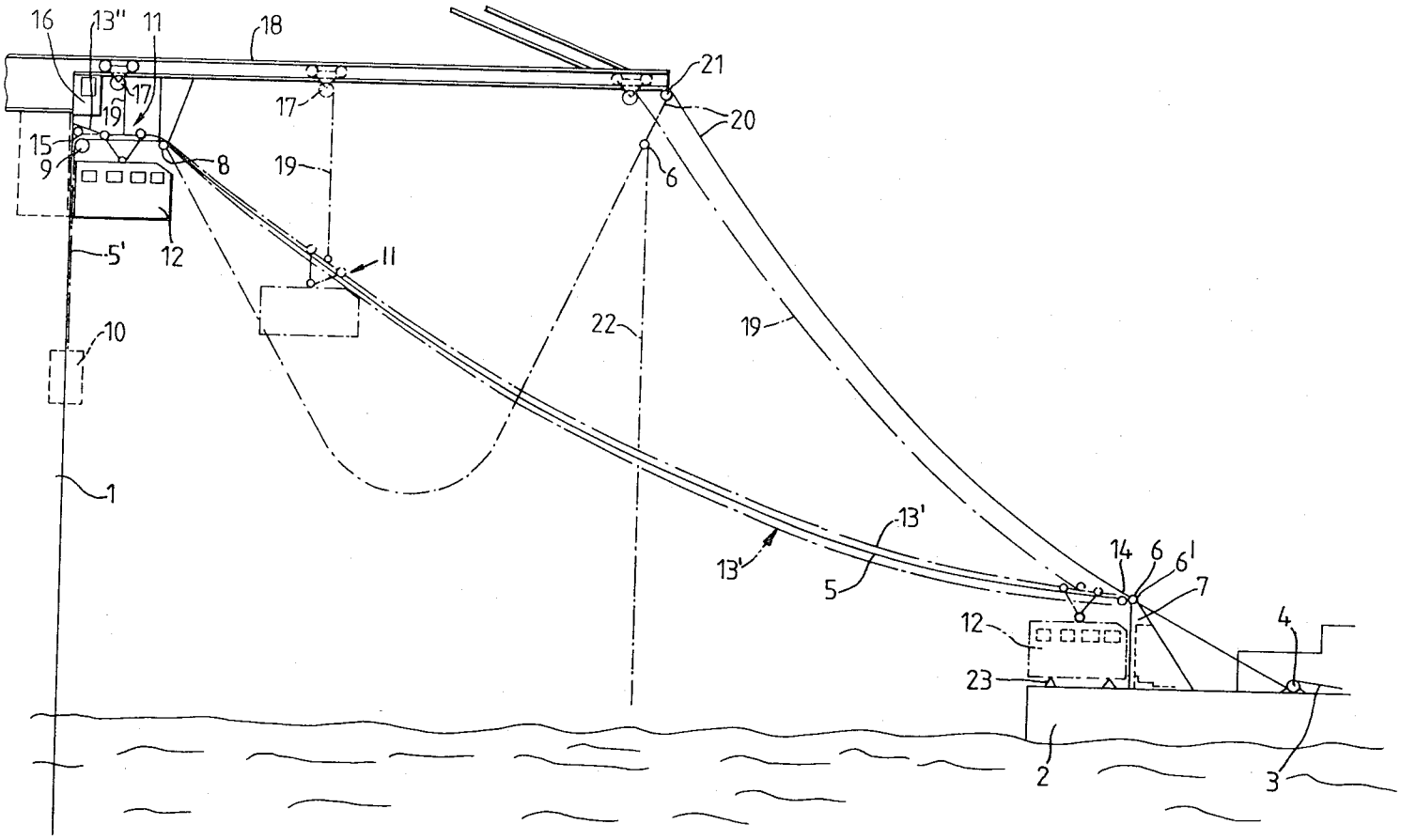
1
2
3
4
5
5'
6
6'
7
8
9
10
11
11
12
12
13'
13'
13''
14
15
16
17
17
18
19
19
19
20
21
22
23

AERIAL CABLEWAY BETWEEN A SEA VESSEL AND A FIXED INSTALLATION

The present invention relates to an aerial cableway for transferring personnel/goods between a vessel and a fixed installation at sea.

At present, the transportation of personnel to and from fixed installations such as drilling platforms and production platforms in the sea is effected by means of helicopter. This is a quick and convenient means of transportation, but it is dangerous, especially under poor weather conditions, as well as being costly.

As a result of recent helicopter accidents which have occurred during such transportation of personnel, an alternate solution using express-speed ferries for this purpose has been discussed. Such vessels could be built to provide substantially greater comfort for passengers than helicopters, and the vessels could also attain speeds which, even in heavy seas, would give an acceptable transport time for personnel.

However, there are certain difficulties associated with a ferry transportation arrangement, primarily, the problem of safely transferring personnel between the vessel and the fixed installation in conditions of heavy seas and high waves. In any such transfer system, one must take into account the fact that the vessel will execute very large vertical movements in the sea in relation to the fixed installation, as well as some degree of horizontal motion, which makes a fixed connection between the installation and the vessel difficult. In the present invention, an aerial cableway is provided for establishing such a connection between a fixed installation and a vessel, the cableway being characterized by the features hereinafter described.

An embodiment of the cableway will be described in greater detail hereinbelow with reference to the accompanying drawing, which is a schematic elevational view showing portions of a fixed installation and a vessel and the cableway which has been established therebetween.

A method for using the cableway will also be discussed in conjunction with the description of this embodiment. The single FIGURE shows a fixed installation 1 and a vessel 2 lying with its stern facing the installation 1, the vessel being moored to two buoys (not illustrated) via mooring lines 3 which travel over two winches 4, one starboard winch and one port winch. A support cable 5, by means of a securing means 6, is attached to a complementary securing means 6' mounted on a construction 7 erected on the vessel 2. The other end of the support cable 5 runs via a roller 8 provided on the fixed installation 1 onto a winch 9 which is provided with a slippage means for maintaining a constant tension in the support cable 5 and thereby also an almost constant arc in said cable during the movements of the vessel 2 in the sea. As a safety precaution, to ensure that the tension in the cable 5 is maintained in an emergency situation, for example, if the winch 9 should fail, a plumb weight 10 is provided on an extended portion 5' of the cable 5, the weight becoming functional through the release of a catch mechanism (not illustrated) which is disconnected in the event of a failure of the winch 9. Suspended from the support cable 5 is a trolley 11 to which a gondola 12 is attached. A pulling cable 13 is attached to the trolley, one part 13' thereof running downwardly, passing over a pulley 14 at the securing point 6,6' of the support cable 5 on the vessel 2, and back up to a pulling winch 15 at the upper end of the support cable 5 on the fixed installation 1. The other part 13'' of the pulling cable travels directly up to and onto the pulling winch 15, which is arranged so as to ensure that the one part of the cable is payed out when the other part is heaved in, and vice-versa. The pulling winch 15 is preferably controlled from the fixed installation 1, on which an operator's cab 16 is provided above the parking place for the gondola 12 in the upper, parked position on the platform.

In one embodiment of the invention, the fixed installation 1 can be provided with outwardly-projecting arms or rails (not shown) onto which the trolley 11 for the gondola 12 runs when it is brought into the upper, parked position on the platform. The rails thus retain the gondola 12 in said position when the support cable 5 is released from the vessel 2 and the tension in the cable thus disappears.

To safeguard the gondola 12 from falling into the sea, or to hoist it up from the sea in the event of, for example, a break in the support cable 5 or too much slack in the support cable 5 as a result of a malfunction of the tensioning means, i.e., the slippage winch 9 or the weight 10, a safety winch 17 is provided which can travel out on an outrigger 18 attached to the installation 1. The safety winch 17, which also is preferably controlled from the operator's cab 16, is connected to the gondola 12 or its trolley 11 via a safety cable 19 which, during the normal travel of the gondola 12 up and down the support cable 5, merely follows slackly along as the safety winch 17 is driven out and in on the outrigger 18. Should the gondola 12 fall into the sea following a break in the support cable 5, or because of too much slack in the support cable owing to a malfunction of one of the components, as discussed above, the gondola 12 can be hoisted up from the sea via the safety winch and brought into the parked position on the fixed installation. If, moreover, one in addition to this safety device also uses, for example, two support cables 5 spaced, say, one meter apart, on which the trolley for the gondola travels, each support cable 5 alone being strong enough to support the gondola 12 when fully loaded, the safety precautions should then be adequate.

At the outer end of the outrigger 18 there is a hoisting line 20 which is attached to the securing means 6 for the support cable 5. The hoisting line serves to lower the securing means down to the vessel 2 and to elevate it from the vessel 2 into a position at the outer end of the outrigger when not in use. The hoisting line 20 can either run over a pulley at the outer end of the outrigger 18 onto a winch (not shown) at the inner end of the outrigger on the installation, or it can run in onto a hoist winch 21 at the outer end of the outrigger, said winch also being controlled from the operator's cab 16. Attached to the securing means 6 is a drop line 22 which, when the securing member 6 and support cable 5 have been hoisted up into the not-in-use position, projects down toward the sea surface, where it can be fished up by a vessel.

When the cableway is provided with the safety winch and safety cable 17, 19 discussed above, it is not necessary to provide the previously-mentioned (but not illustrated) outwardly-projecting arms or rails for retaining the gondola 12 in the parked position on the fixed installation, since the gondola 12 will in this case hang suspended from the safety cable 19 which is drawn in by the safety winch 17.

In the actual use, the cableway can be operated as follows: The vessel 2, which has approached the fixed installation 1, attaches two mooring lines 3 to two buoys (not shown) in the sea, said mooring lines 3 passing over respective mooring winches 4 on the starboard and port sides of the vessel, respectively. The vessel thereafter reverses toward the fixed installation as the mooring lines 3 are payed out from the winches 4, and picks up the drop line 22 which hangs down from the securing member 6 for the support cable 5. The drop line 22 is used to winch in said securing member 6 in order to secure it to its complementary securing member 6', mounted on the construction 7 on the vessel 2. This operation is performed in cooperation with the operator in the cab 16 on the installation, because the hoisting cable 20 must be payed out from the hoisting winch 21 which is controlled from the cab 16. When the securing member 6 for the support cable 5 has been attached to the vessel 2, the support cable 5 is tautened by means of the vessel's motor power while at the same time the two mooring winches 4 draw in the mooring lines 3, whereby the vessel becomes anchored to the said buoys (not illustrated on the drawing). As stated previously, the slippage winch 9 on the fixed installation thereafter ensures that constant tension is maintained in the support cable 5. The gondola 12 is then driven down to the vessel 2 by means of the pulling cable 13 and the pulling winch 15, the gondola coming to rest on a foundation which, for example, may consist of hydraulic pillows 23 to cushion shocks as the gondola lands on the deck of the vessel. The gondola, in the embodiment example illustrated herein, is provided with a door at either end, one door being aligned with an opening in the construction 7 on the vessel 2 through which personnel can walk and goods be transported into and out of the gondola 12. The door at the other end of the gondola corresponds with a similar opening with a door on the fixed installation 1, providing access for personnel and goods to the fixed installation 1 after the gondola 12 has been hoisted up from the vessel 2 into the parked position.

Having described my invention, I claim:

1. An aerial cableway for transportation between a vessel and a fixed installation at sea, consisting of a support cable stretched between the vessel and the fixed installation, means for maintaining constant tension in the support cable, means for releasably attaching the suport cable to the vessel, a gondola suspended from a trolley on the support cable, a pulling line attached to the trolley, of the pulling line travelling over a pulley on the vessel and running back to the fixed installation onto pulling winches one at each end of the pulling line on the fixed installation, whereby one end of the pulling line pays out when the other end is heaved in, and vice-versa, an outrigger on the fixed installation, at the outer end of which a securing member for the support cable is fastened so as to enable said support cable to be raised and lowered, a hoisting cable which is maneouverable from the fixed installation for raising and lowering said securing member and a drop line attached to the securing member which, when the securing member and thus also the support cable have been hoisted into an elevated, not-in-use position, hangs down toward the surface of the sea.

2. A cableway as recited in claim 1, and a travelling winch that moves lengthwise along the outrigger, a safety cable extending between the travelling winch and the gondola trolley, the travelling winch being adapted to follow the gondola with a slack safety line when the gondola is driven on the support cable, and to hoist up the gondola in the event of a break in or of too much slack in the support cable.

* * * * *